US007028695B2

(12) United States Patent
Montoli et al.

(10) Patent No.: US 7,028,695 B2
(45) Date of Patent: Apr. 18, 2006

(54) MASCARA BRUSH WITH SPLIT HOLLOW FILAMENTS

(75) Inventors: Antonio Montoli, Brookfield, CT (US); Raymond P. LeGassie, Laconia, NH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 125 days.

(21) Appl. No.: 10/175,567

(22) Filed: Jun. 18, 2002

(65) Prior Publication Data

US 2003/0230317 A1 Dec. 18, 2003

(51) Int. Cl.
*A45D 40/26* (2006.01)
*A46B 29/17* (2006.01)

(52) U.S. Cl. ..... 132/218; 15/206; 15/207.2

(58) Field of Classification Search ..... 132/218, 132/317, 320, 313; 15/206, 160, 159.1, 207.2; 401/119, 129
See application file for complete search history.

(56) References Cited

U.S. PATENT DOCUMENTS

| | | | | |
|---|---|---|---|---|
| 4,733,425 | A | 3/1988 | Hartel et al. | |
| 4,887,622 | A | 12/1989 | Gueret | |
| 5,020,551 | A | 6/1991 | Guerret | |
| 5,063,947 | A | 11/1991 | Gueret | |
| 5,133,590 | A | 7/1992 | Fitjer | |
| 5,165,760 | A | 11/1992 | Gueret | |
| 5,380,592 | A | 1/1995 | Tung | |
| 5,761,760 | A * | 6/1998 | Dumler et al. | 15/206 |
| 5,778,476 | A | 7/1998 | Squillaci et al. | |
| 5,933,906 | A | 8/1999 | Rackley | |
| 6,048,615 | A | 4/2000 | Lin | |
| 6,241,411 | B1 | 6/2001 | Brieva et al. | |

FOREIGN PATENT DOCUMENTS

| | | |
|---|---|---|
| DE | 297 00 611 | 1/1997 |
| EP | 0 130 611 | 1/1995 |
| FR | 2663826 | 1/1992 |
| GB | 2 225 225 | 5/1990 |
| GB | 2225225 | 5/1990 |
| WO | WO 01/58309 | 8/2001 |
| WO | WO 01/583309 | 8/2001 |

OTHER PUBLICATIONS

DuPont® Tynex Filaments; Product Availability specifications.
DuPont® Tynex Filaments; Mascara Product Applications specifications.
International Search Report of Application No. PCT/EP03/06087.

* cited by examiner

*Primary Examiner*—John J. Wilson
*Assistant Examiner*—Robyn Doan
(74) *Attorney, Agent, or Firm*—St. Onge Steward Johnston & Reens LLC

(57) ABSTRACT

A mascara brush and method of manufacture thereof provides a mascara brush with bristle fibers that are split into numerous fragments. The mascara brush is made with bristle fibers having longitudinal voids. The brush is then conditioned by passing a rotating wire wheel over the bristle fibers . The wire wheel splits the bristle fibers into numerous bristle fragments. The conditioned brush is softer to the touch than the original mascara brush. The conditioning can be applied to the entire brush or one or more zones of the brush. The conditioning can be shallow, so that only the bristle tips are conditioned, or deep, so that a substantial length of the bristle is conditioned.

9 Claims, 3 Drawing Sheets

MASCARA BRUSH WITH SPLIT HOLLOW FILAMENTS

FIELD OF THE INVENTION

The present invention relates to a brush for applying cosmetic products, in particular, mascara, to eyelashes.

BACKGROUND OF THE INVENTION

Twisted wire brushes for application of liquid-type cosmetics, such as for application of mascara to the eyelashes, are well known in the art. The brushes are designed to pick up and hold a supply of mascara from the cosmetic container, and then deliver the mascara to the eyelashes as the brush is combed through the lashes by the user.

Twisted wire brushes conventionally are manufactured by disposing a plurality of individual lengths of bristles transverse to and between substantially parallel, slightly spaced-apart thin metal wire lengths, such that the wire lengths generally bisect the filament lengths at their midpoints. Most typically, the parallel wire lengths comprise the two substantially equal leg lengths formed from bending a single length of wire into a U-shaped configuration. The wire lengths are then twisted together to form a helical core, causing the bristles disposed between the wires to be clamped therebetween at about their midpoints. In the twisting and clamping, the segments of the bristles on either side of the clamped midpoint are caused to flare radially outward from the core and so form an elongate bristle brush portion of generally circular cross-section. The brush is generally provided with a handle which can comprise, or be affixed to, a cap or other closure for the cosmetic container. The bristles are usually comprised of nylon filaments.

It is known in the art that this helical wire twisting method for forming cosmetic applicator brushes typically leads to a brush configuration in which the bristles tend generally to follow the helical pattern of the twisted wire core, i.e., whereby the tips of the bristles define a helix. Standard mascara brush designs of the 1960s and 1970s used smaller diameter bristles in fairly large numbers of bristles per turn. The state of the art then evolved to a somewhat larger diameter bristle, as defined in U.S. Pat. No. 4,887,622 entitled "Brush for the Application of Mascara to the Eyelashes." The patent discloses a mascara brush having a reduced number of bristles, said to be 35% to 80% less than in conventional mascara brushes, ostensibly of larger diameter, than the bristles employed in conventional mascara brushes at the time. This was believed to provide a better application of mascara and separation of lashes. The patent specifies mascara brushes having a bristle diameter from about 0.10 to 0.25 mm (e.g. about 0.004 to 0.010 inch) (4 mil to 10 mil) and with from approximately 10 to 40 bristles per turn of the helix. The concept of a mascara brush having larger diameter fibers was further discussed in a recent PCT application no. PCT/U.S.01/04555. This application is directed towards mascara brushes made from filaments that are relatively large but soft. Specifically, the application describes mascara brushes having preferably having 7–14 bristles per turn. The bristle filaments are defined as preferably being from 0.010 inch to 0.013 inch (10 mil to 13 mil). Most critically, the bristles are defined as being relatively soft being made of a thermoplastic elastomer having a durometer of between 62 Shore D and 82 Shore D, but most preferably about 72 Shore D. PCT application PCT/US01/04555 essentially defines a mascara brush made with a duPont Filaments filament sold under the trademark "Supersoft." The "Supersoft" filaments have a durometer of 72 Shore D and are available as solid filaments or as triocular filaments having three hollow voids.

Mascara, which is typically highly viscous, tends to clump when applied to eyelashes. The clumps of mascara are typically combed out as a finishing step to the application process. Stiffer bristles are thought to be better suited for combing out clumps and properly separating lashes. However, the combing and separating functions are thought to be better accomplished with brushes a having relatively open bristle envelope or brush surface, i.e., an envelope or surface that has numerous or wide clearances or spaces between bristles to make the brushes more 'comb-like'. This function is not well served by traditional mascara brush designs having smaller diameter bristles with higher bristle density. A mascara brush with softer, more numerous bristles has been generally thought to be well suited for applying mascara but less well suited for combing out clumps and separating lashes. Conversely, a brush with stiffer, fewer bristles has been thought to be well suited for combing and separating lashes but less well suited for applying mascara to lashes. While a separate brush can be used for each function, i.e., a soft brush for application and a stiff brush for combing, a single brush that can both apply mascara and comb out clumps would be preferred for the convenience of the user. An example of a brush said to provide good application and combing characteristics is shown in U.S. Pat. No. 5,238,011 to Gueret. The Gueret patent discloses bristles made of a soft material having a shore hardness of 20 A to 40 D (as noted above, a conventional bristle typically has a durometer of over 85 D), and a large diameter in a range of 0.004 inch to 0.014 inch (4 to 14 mil) (0.10 to 0.35 millimeter). As disclosed by Gueret, the diameter is said to be sufficiently large to prevent too high a degree of suppleness. The resulting brush is said to have the same degree of suppleness or softness as a conventional softer brush.

Nevertheless, there can be a perception of bristle hardness to the mascara user. In many prior art brushes, the prior art approaches have not provided a brush with a combination of all the desirable features for a mascara brush—a soft bristle feel, combined with bristle stiffness suitable for high viscosity mascaras, while still providing both a good combing effect as well as high mascara loading.

SUMMARY OF THE INVENTION

A mascara brush and method of manufacture thereof provides a mascara brush with bristle fibers that are split into numerous fragments. The mascara brush is made with bristle fibers having longitudinal voids. The brush is then conditioned by passing a rotating splitting tool along the body of the mascara brush. The splitting tool splits the bristle fibers into numerous bristle fragments. The conditioned brush is softer to the touch than the original mascara brush. The conditioning can be applied to the entire brush or one or more zones of the brush. The conditioning can be shallow, so that only the bristle tips are conditioned, or deep, so that a substantial length of the bristle is conditioned. The conditioned bristles comprise about two to ten bristle fragments formed from each original bristle, more typically, about two to six bristle fragments formed from each original bristle.

DETAILED DESCRIPTION OF THE DRAWINGS

Figure 1:
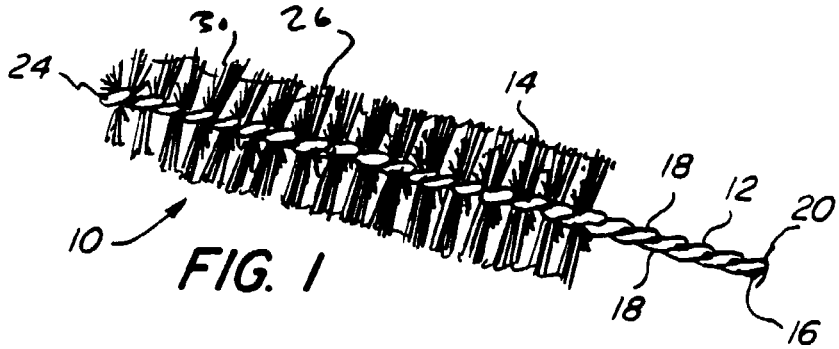
FIG. 1 is a side elevation view of a mascara brush in accordance with the invention.

Referring now to FIG. 1, a mascara applicator brush, designated generally by reference numeral 10, is shown. The brush is intended for use in a typical mascara bottle (not shown) with an opening into which the brush 10 is inserted.

The brush 10 is comprised of a central twisted wire core 12 containing bristles 14. The core 12 is a twisted wire core typically made by forming a soft metal wire 16 into a "U" shape. A plurality of bristles 14 are placed between the segments 18 of wire 16. The wire segments 18 are then twisted about the longitudinal axis to clamp bristles 14 at approximately a midpoints of the bristles 14. The bristle ends extend radially from the twisted wire core 12. Core 12 has a lower end 20 connected to a shaft, and an upper end 24 opposite the lower end 20. The lower end 20 of the core 12 is connected to a handle by way of the shaft, however, the lower end 20 of the core 12 could alternatively be attached to another structure such as a bottle cap.

Figure 2:
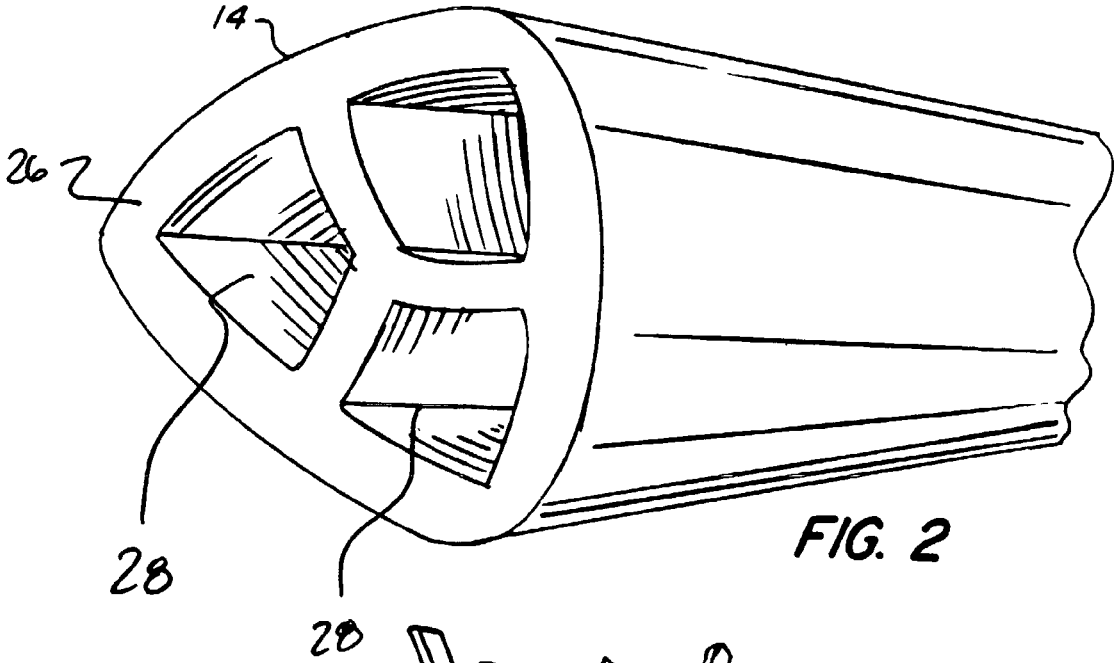
FIG. 2 is a cross-sectional view of a hollow bristle, made from a triocular filament having three longitudal hollow voids.

Referring now to FIG. 2., at least some, and preferably, all the bristles 14 (or the filament from which they are made) are hollow in cross-section at least at their ends 26, and preferably along their entire length. The hollow cross-section is provided by having from one to four longitudinal voids 28. The bristles 14 may thus have a single void 28 or multiple, radially adjacent voids 28. Each void 28 may extend through the cross-section continuously along the length of each bristle 14, or may be provided in the cross-section at spaced intervals along the length of each bristle 14, or only at the ends 26 of the bristle. The bristles 14 may be round in cross-section, or have other cross-sectional shapes, such as oval or triangular. In the preferred embodiment, as shown in FIG. 2, the bristles 14 may be triocular, e.g. have three voids 28 running the length of the bristle.

Bristles 14 are typically made by cutting short segments from spools of filaments. The preferred materials for making the bristles are nylon filament or polyester filament. In one embodiment of the invention, the bristles preferably have a diameter of from 0.010 inch to about 0.016 inch (10 mil to 16 mil). More preferably, in this embodiment, the diameter of the bristles 14 will be 0.011 inch to 0.013 inch (11 mil to 13 mil), most preferably, about 0.11 inch (11 mil). As noted, the filaments may be round or may have non-circular cross-sectional shapes, thus, the term "diameter" as used herein is intended to mean the maximum distance between any of the possible opposite positions on the outer surface of a bristle 14. In the above mentioned embodiment, the bristle density is in the range of 8 to 20 bristles per turn; more preferably 10–15 bristles per turn, and most preferably 12–14 bristles per turn. The filaments from which the bristles 14 are made can be selected based on their hardness. In this embodiment, the filaments may, if desired, be fairly soft, for example, the duPont "Supersoft" fibers having a durometer of between 62 Shore D and 82 Shore D can be used. However, due to the conditioning process which gives a feel of softness, even much harder filaments can be used, including filaments having a durometer in the range of about 92 Shore D hardness to 120 Rockwell R; more preferably about 100 to 120 Rockwell R; most preferably about 103 to 108 Rockwell R.

Figure 4:
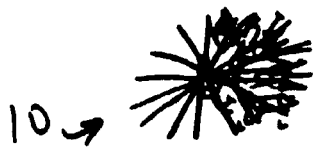
FIG. 4 is an cross-sectional view illustrating a mascara brush which has been conditioned in one zone.
Figure 5:
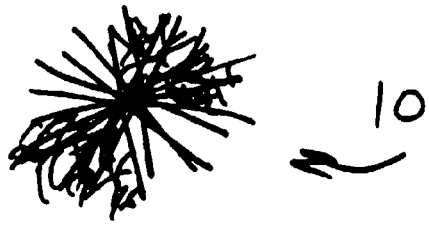
FIG. 5 is a cross-sectional view illustrating a mascara brush which has been conditioned in two zones.

The bristle ends 26 of the mascara brush are conditioned to provide a softer feel to the bristle ends 26. The bristle ends 26 are conditioned by splitting them, either around the outer entire surface of the brush as in FIG. 1, or only in selected zones of the outer surface of the mascara brush. For example, as illustrated in FIG. 4, the conditioning of the brush can be on one side of the brush outer surface (e.g. a zone comprising from about 45° to about 180° of the brush exterior circumference); or as illustrated in FIG. 5, on different sides of the brush exterior surface (e.g. two oppositely positioned zones, each zone being from about 45° to about 90° of the brush exterior circumference).

Figure 3:
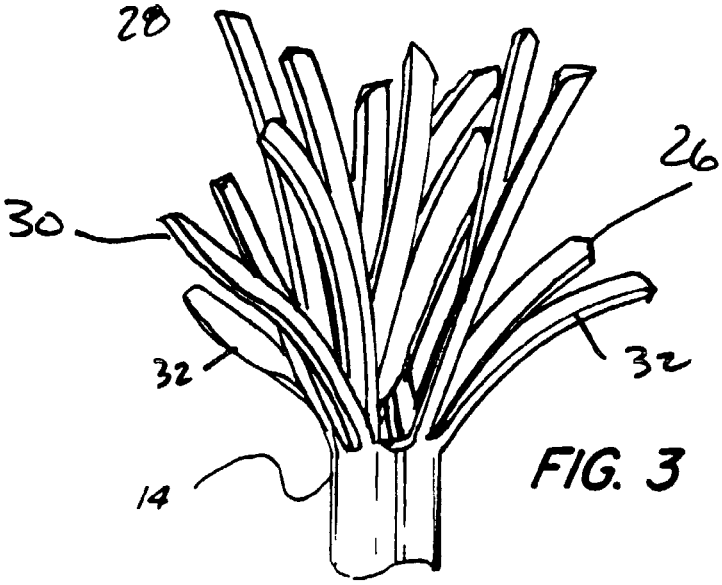
FIG. 3 is a side elevation view of a bristle end which has been split by a wire wheel.
Figure 8:
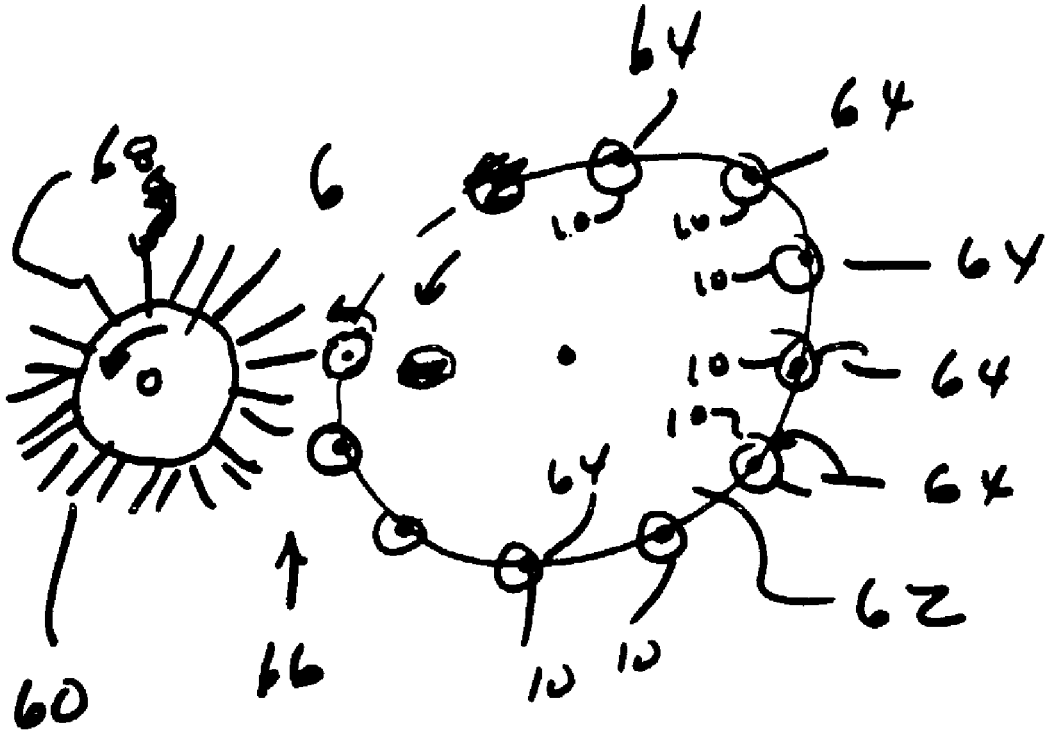
FIG. 8 is an illustration of the process of the invention.
Figure 1:
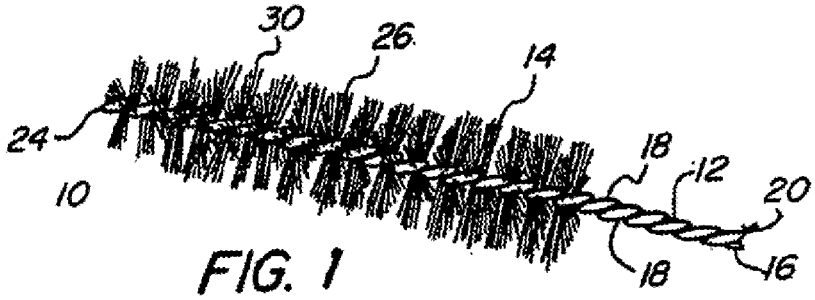
Figure 2:
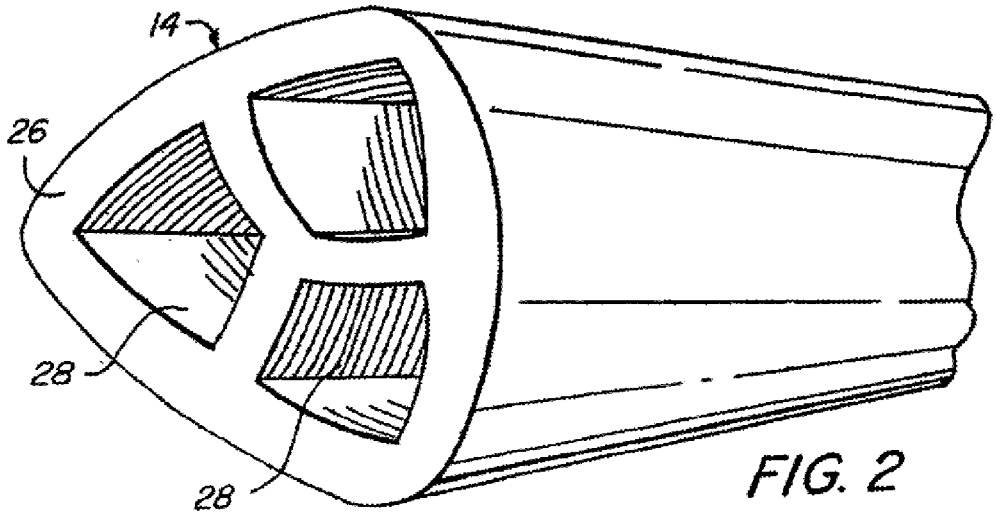
Figure 3:
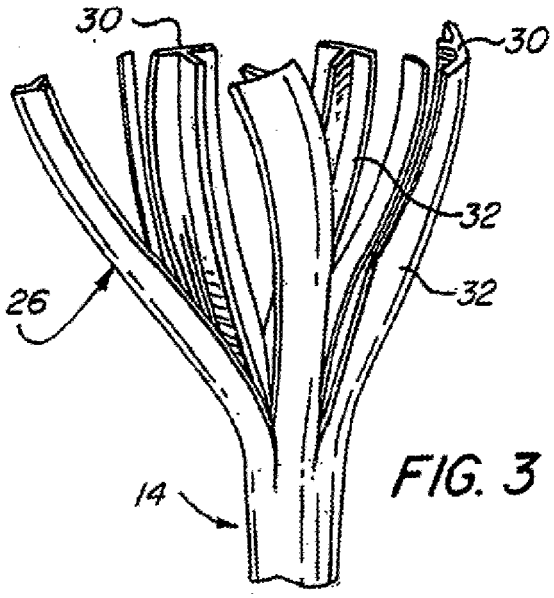
Figure 4:
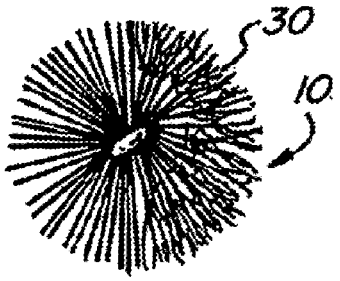
Figure 5:
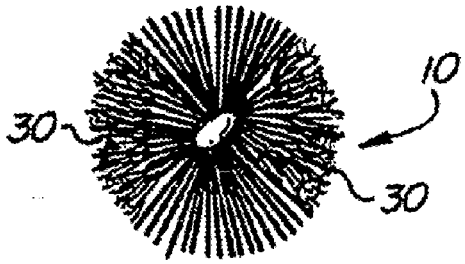
Figure 6:
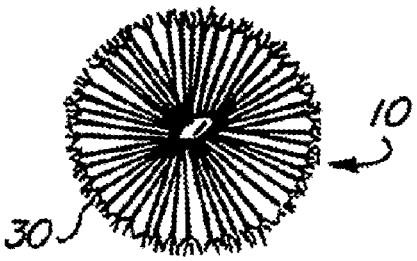
Figure 7:
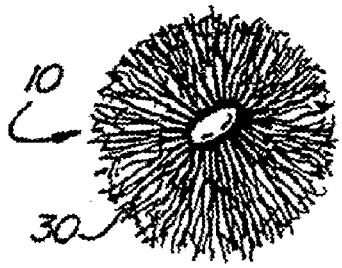
Figure 8:
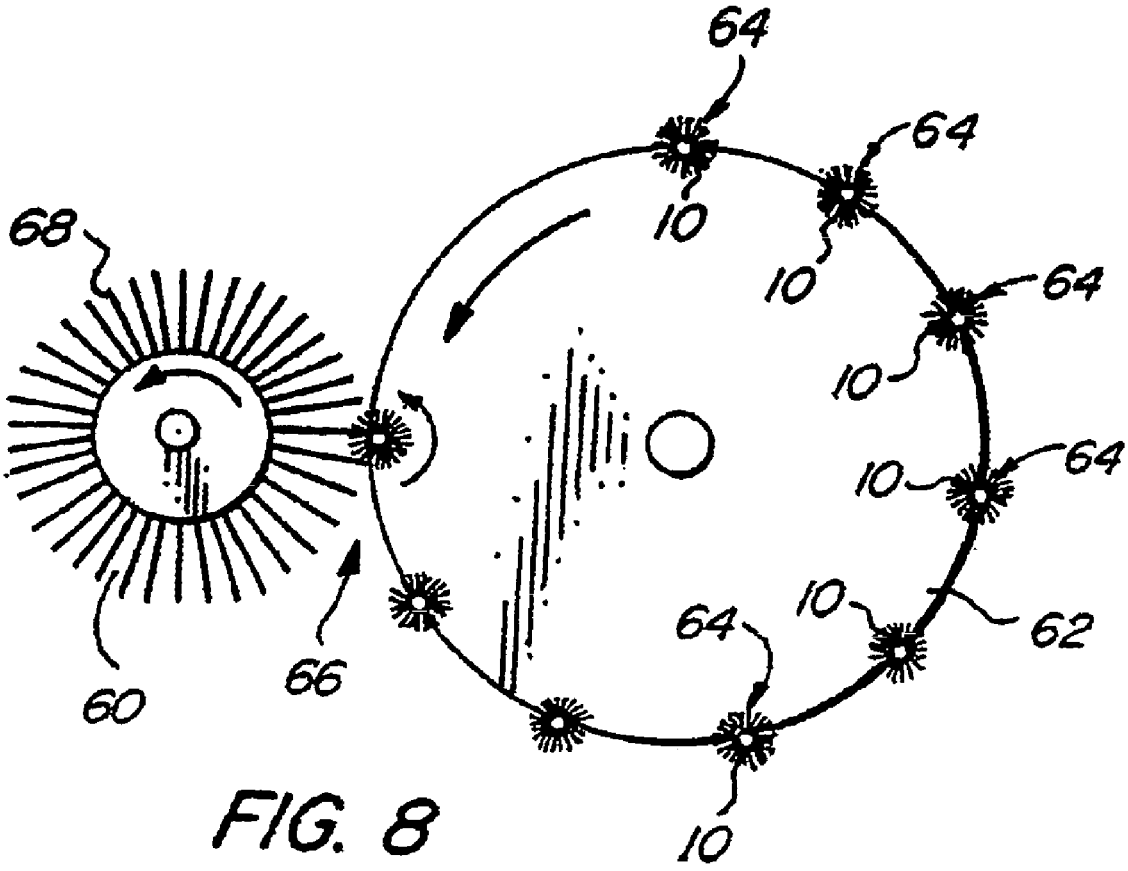

As shown in FIG. 8, the bristle ends 26 are conditioned by slitting with a spinning wire wheel 60, or alternatively, by sharp metal knife blades mounted on a rotating spindle. The conditioned ends 30 of the bristles, as shown in FIG. 3, are split into many fingers, which provide enhanced mascara holding and application to eye lashes, along with a soft feel to the touch.

In a preferred process for conditioning mascara brushes in accordance with the invention, an indexing dial plate 62 holds 8 collet mechanisms 64. Each collet mechanism is suited to hold a mascara brush 10. Mascara brushes are loaded to the dial plate 62, rotated to a conditioning station, then released when conditioning is completed. At the conditioning station 66, the brush is held in place by a pin that holds the free upper end of the brush, and the collet mechanism, which hold the lower end of the brush. Wire wheel 60 is mounted on an electric motor, which causes the wire wheel 60 to rotate at between about 500 to about 3000 rpm. Preferably, the wire wheel 60 has a diameter of 4 inches and a width of 0.5 inch. In the preferred embodiment, the axis of the mascara brush 10 and the axis of the rotating wire wheel 60 are parallel, and the rotating wire wheel 60 can index back and forth to condition along the length of the body of the mascara brush 10. However, it is also possible to position the axis of the rotating wire wheel at 90 degrees to the axis of the mascara brush and move the rotating wire wheel 60 along the body of the brush 10.

The wire tips 68 of the wire wheel 60 engage the ends 26 of the bristles 14 of the mascara brush and tear and split many of the ends of the bristles 14 into two or more thinner bristle fragments 32. The possible range for generating bristle fragments 32 is about two to ten bristle fragments 32 for each original bristle end 26. In the preferred embodiment, there will typically be about two to six bristle fragments 32 for each original bristle end 26 conditioned by the wire wheel process. However, not all bristles 14 in a conditioned zone will be conditioned to the same extent. Some bristles 14 may be unaffected. Some may be split into 2 bristle fragments 32. Some may be split into six bristle fragments 32. The average number of bristle fragments 32 will be in the range of about 2 to about 3.8 bristle fragments per original bristle end. In one embodiment, the average number of bristle fragments 32 was about 2.9 bristle fragments 32 per original bristle end 26.

It should be noted that the conditioning can be applied principally to the tip ends of the bristles 14, as shown in FIG.

Figure 7:
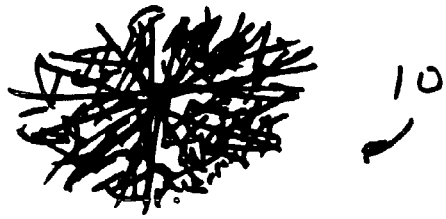
FIG. 7 is a cross-sectional view illustrating a mascara brush which has been conditioned along a substantial length of the bristle fibers.

6, or alternatively, can be applied to the entire length of a bristle 14 that extends from the twisted wire core 12 as shown in FIG. 7. However, the portion of the bristle 14 fiber gripped by the metal wire 16 of the bristle core 12 will usually remain intact and unaffected by the conditioning process. In the first mentioned approach, where the conditioning is applied to the tip ends only, the conditioned zones of the resulting mascara brush 10 will be of the type used for volumizing bulk, but with soft bristle tips. In the second mentioned approach, the conditioned zones will have a softer feel as a substantial portion of the bristle 14 will have been split.

The mascara brush of the invention provides a brush with a new and unique feel. While the invention has been described and illustrated as embodied in preferred forms of construction, it will be understood that various modifications may be made in the structure and arrangement of the parts without departing from the spirit and the scope of the invention recited in the following claims.

What is claimed is:

1. A brush for applying mascara to eyelashes, comprising: a straight twisted wire core holding a plurality of radially extending bristles to form a brush at an end of the core, at least some of said bristles having one or more longitudinal hollow voids therein, said brush having at least one first zone which is less than the entire outer surface of the brush and which extends around only a portion of the diameter of an outer surface of said brush and along a length of the outer surface of the brush in said portion of the diameter of the outer surface of the brush, and in which ends of bristles in said at least one first zone have been conditioned by the process of placing ends of the bristles against a rotating wire wheel to split some bristles in said first zone into two or more bristle fragments such that said conditioned bristles have a softer feel and have a larger mascara product carrying capacity than bristle ends which have not been conditioned; said brush having at least one second zone which is less than the entire outer surface of the brush and which extends around only a portion of the diameter of an outer surface of said brush and along a length of the outer surface of the brush in which ends of bristles in said at least one second zone are not conditioned such that said unconditioned bristles are stiffer than said conditioned bristles and provide lengthening and combing to a user's eyelashes.

2. A brush in accordance with claim 1, wherein said bristles are made from triocular fibers having three longitudinal hollow voids.

3. A brush in accordance with claim 1, wherein said conditioned bristles are located on one side of said mascara brush.

4. A brush in accordance with claim 1, wherein said conditioned bristles are located on two opposing sides of said mascara brush.

5. A brush in accordance with claim 1 or 2, wherein some of said conditioned bristles are conditioned in a bristle tip end section of said conditioned bristles.

6. A brush in accordance with claim 1 or 2, wherein said conditioned bristles are conditioned along a substantial portion of a length of said conditioned bristles.

7. A brush in accordance with claim 1 or 2, wherein said conditioned bristles comprise about two to ten bristle fragments formed from each original bristle.

8. A brush in accordance with claim 7, wherein said conditioned bristles comprise about two to six bristle fragments formed from each original bristle.

9. A brush in accordance with claim 1 or 2, wherein said conditioned bristles comprise on average about 2 to about 3.8 bristle fragments formed from each original bristle.

* * * * *

UNITED STATES PATENT AND TRADEMARK OFFICE

CERTIFICATE OF CORRECTION

PATENT NO. : 7,028,695 B2 
APPLICATION NO. : 10/175567
DATED : April 18, 2006
INVENTOR(S) : Antonio Montoli et al.

It is certified that error appears in the above-identified patent and that said Letters Patent is hereby corrected as shown below:

Figure 1 should be replaced with:

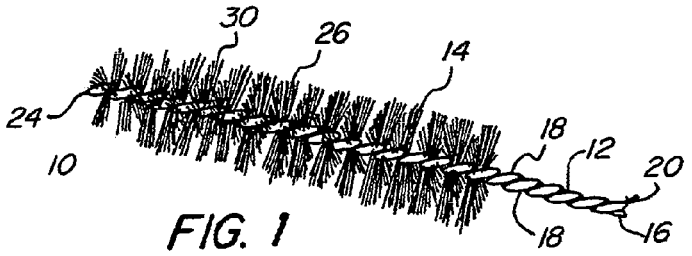

FIG. 1

Figure 2 should be replaced with:

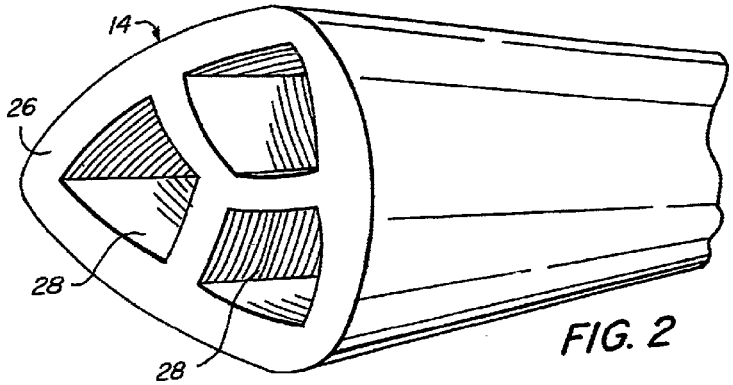

FIG. 2

UNITED STATES PATENT AND TRADEMARK OFFICE

CERTIFICATE OF CORRECTION

PATENT NO. : 7,028,695 B2
APPLICATION NO. : 10/175567
DATED : April 18, 2006
INVENTOR(S) : Antonio Montoli et al.

It is certified that error appears in the above-identified patent and that said Letters Patent is hereby corrected as shown below:

Figure 3 should be replaced with:

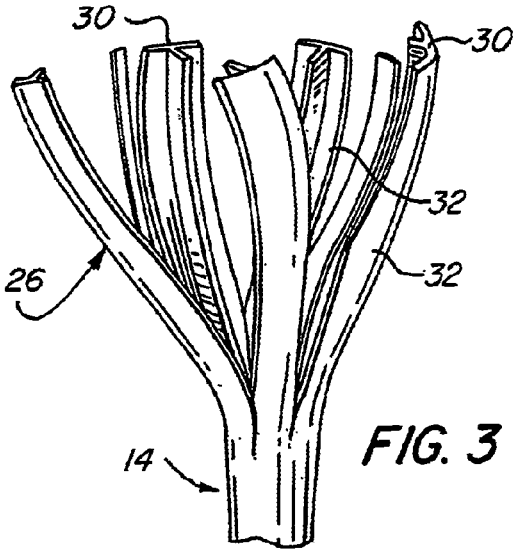

FIG. 3

Figure 4 should be replaced with:

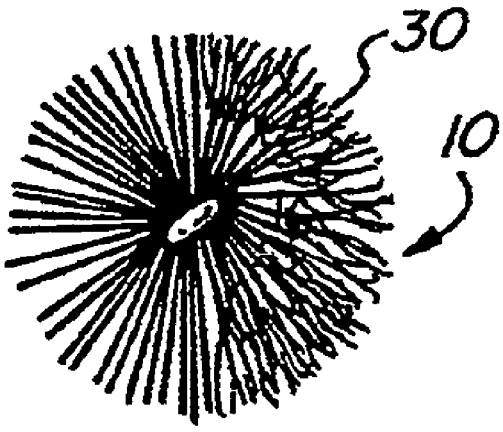

FIG. 4

UNITED STATES PATENT AND TRADEMARK OFFICE

CERTIFICATE OF CORRECTION

PATENT NO. : 7,028,695 B2
APPLICATION NO. : 10/175567
DATED : April 18, 2006
INVENTOR(S) : Antonio Montoli et al.

It is certified that error appears in the above-identified patent and that said Letters Patent is hereby corrected as shown below:

Figure 5 should be replaced with:

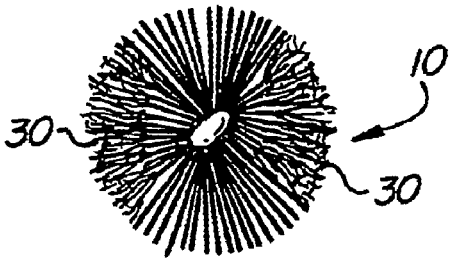

FIG. 5

Figure 6:
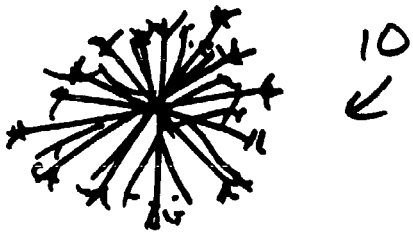
FIG. 6 is a cross-sectional view illustrating a mascara brush which has been conditioned at the bristle tip ends.

Figure 6 should be replaced with:

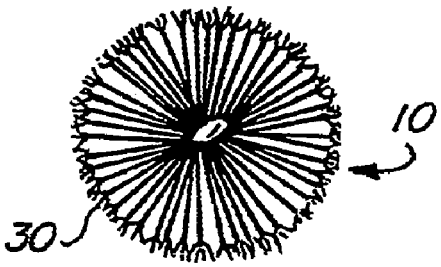

FIG. 6

Figure 7 should be replaced with:

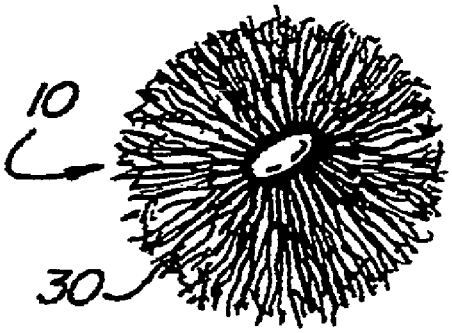

FIG. 7

UNITED STATES PATENT AND TRADEMARK OFFICE

CERTIFICATE OF CORRECTION

PATENT NO. : 7,028,695 B2
APPLICATION NO. : 10/175567
DATED : April 18, 2006
INVENTOR(S) : Antonio Montoli et al.

It is certified that error appears in the above-identified patent and that said Letters Patent is hereby corrected as shown below:

Figure 8 should be replaced with:

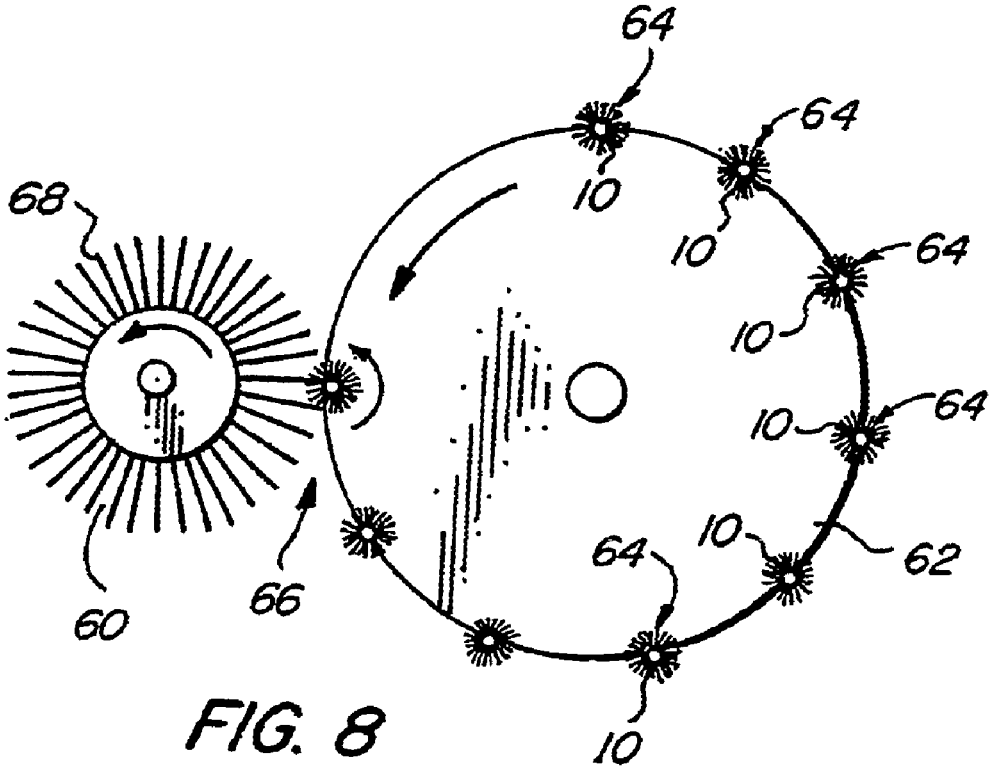

FIG. 8

Signed and Sealed this

Fifth Day of December, 2006

JON W. DUDAS
*Director of the United States Patent and Trademark Office*

(12) United States Patent
Montoli et al.

(10) Patent No.: US 7,028,695 B2
(45) Date of Patent: Apr. 18, 2006

(54) MASCARA BRUSH WITH SPLIT HOLLOW FILAMENTS

(75) Inventors: Antonio Montoli, Brookfield, CT (US); Raymond P. LeGassie, Laconia, NH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 125 days.

(21) Appl. No.: 10/175,567

(22) Filed: Jun. 18, 2002

(65) Prior Publication Data

US 2003/0230317 A1 Dec. 18, 2003

(51) Int. Cl.
*A45D 40/26* (2006.01)
*A46B 29/17* (2006.01)

(52) U.S. Cl. ..... 132/218; 15/206; 15/207.2

(58) Field of Classification Search ..... 132/218, 132/317, 320, 313; 15/206, 160, 159.1, 207.2; 401/119, 129

See application file for complete search history.

(56) References Cited

U.S. PATENT DOCUMENTS

| | | | | |
|---|---|---|---|---|
| 4,733,425 | A | 3/1988 | Hartel et al. | |
| 4,887,622 | A | 12/1989 | Gueret | |
| 5,020,551 | A | 6/1991 | Guerret | |
| 5,063,947 | A | 11/1991 | Gueret | |
| 5,133,590 | A | 7/1992 | Filjer | |
| 5,165,760 | A | 11/1992 | Gueret | |
| 5,380,592 | A | 1/1995 | Tung | |
| 5,761,760 | A * | 6/1998 | Dumler et al. | 15/206 |
| 5,778,476 | A | 7/1998 | Squillaci et al. | |
| 5,933,906 | A | 8/1999 | Rackley | |
| 6,048,615 | A | 4/2000 | Lin | |
| 6,241,411 | B1 | 6/2001 | Brieva et al. | |

FOREIGN PATENT DOCUMENTS

| | | |
|---|---|---|
| DE | 297 00 611 | 1/1997 |
| EP | 0 130 611 | 1/1995 |
| FR | 2663826 | 1/1992 |
| GB | 2 225 225 | 5/1990 |
| GB | 2225225 | 5/1990 |
| WO | WO 01/58309 | 8/2001 |
| WO | WO 01/583309 | 8/2001 |

OTHER PUBLICATIONS

DuPont® Tynex Filaments; Product Availability specifications.
DuPont® Tynex Filaments; Mascara Product Applications specifications.
International Search Report of Application No. PCT/EP03/05087.

* cited by examiner

*Primary Examiner*—John J. Wilson
*Assistant Examiner*—Robyn Doan
(74) *Attorney, Agent, or Firm*—St. Onge Steward Johnston & Reens LLC

(57) ABSTRACT

A mascara brush and method of manufacture thereof provides a mascara brush with bristle fibers that are split into numerous fragments. The mascara brush is made with bristle fibers having longitudinal voids. The brush is then conditioned by passing a rotating wire wheel over the bristle fibers . The wire wheel splits the bristle fibers into numerous bristle fragments. The conditioned brush is softer to the touch than the original mascara brush. The conditioning can be applied to the entire brush or one or more zones of the brush. The conditioning can be shallow, so that only the bristle tips are conditioned, or deep, so that a substantial length of the bristle is conditioned.

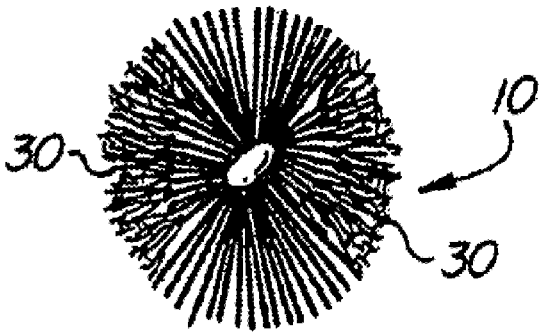

9 Claims, 3 Drawing Sheets